United States Patent [19]

Marie

[11] Patent Number: 4,869,423

[45] Date of Patent: Sep. 26, 1989

[54] PANEL INTERLOCKING ARRANGEMENT

[75] Inventor: Philippe Marie, Chateauroux, France

[73] Assignee: The Mead Corporation, Dayton, Ohio

[21] Appl. No.: 243,962

[22] Filed: Sep. 14, 1988

Related U.S. Application Data

[63] Continuation-in-part of Ser. No. 121,386, Nov. 16, 1987, abandoned.

[30] Foreign Application Priority Data

Jan. 14, 1987 [GB] United Kingdom ..... 8700777

[51] Int. Cl.[4] ..... B65D 65/06

[52] U.S. Cl. ..... 229/40; 206/140; 206/427; 229/185

[58] Field of Search ..... 217/3 FC; 206/140, 427; 229/40, 48 R

[56] References Cited

U.S. PATENT DOCUMENTS

| | | | |
|---|---|---|---|
| 3,410,397 | 11/1968 | Cato | 229/40 |
| 3,508,699 | 4/1970 | Graser | 217/3 FC |
| 4,243,143 | 1/1981 | Muller | 229/40 |
| 4,471,903 | 9/1984 | Humphries | 229/40 |
| 4,597,523 | 7/1986 | Schuster | 229/40 |

*Primary Examiner*—Gary Elkins
*Attorney, Agent, or Firm*—Erwin Doerr

[57] ABSTRACT

Panel interlocking means (45,46) for securing together a pair of panels (13,28) in overlapping relationship includes a locking tab (45) struck from one of the panels (12) and arranged to be driven through a locking aperture (46) struck from the other panel (28). The opposed lateral edges (**45*a*, 45*b*) of the locking tab have deformable marginal portions (a) formed by cut lines (b, c) which are deformed by the opposed lateral edges (46*a*, 46*b***) of the locking aperture when the locking tab is driven through the locking aperture.

15 Claims, 2 Drawing Sheets

PANEL INTERLOCKING ARRANGEMENT

The present application is a continuation-in-part of application Ser. No. 121,386 filed Nov. 16, 1987, abn.

This invention relates to a panel interlocking arrangement and to cartons, particularly foldable wrappers, having such interlocking means. Known wrappers often comprise a blank which has a top wall panel, two side wall panels and two overlapping base panels hinged together by means of fold lines, one base panel having locking tabs which are engaged in cooperating openings provided in the other base panel, the locking tabs preferably being supported in an inwardly inclined position by retaining tabs which are struck from such openings.

The articles which are to be packaged within such foldable wrappers usually have the same nominal dimensions. In practice however, the dimensional tolerances of the articles which may occur within an individual package are relatively high. This applies especially to multi-way bottles, because numerous types of bottles whose dimensions are similar but not absolutely identical, are in circulation. Manufacturing tolerances are not the only reason for this, but there is also the fact that there has not been hitherto an adequate standardisation for bottle dimensions. Even after the introduction of a standard for the dimensions of bottles, bottles which differ from this standard are still in circulation.

In a foldable wrapper it is known from GB No. 2 019 804B to compensate for tolerances by providing on one base panel self-adjusting locking tabs having lateral edges of undulatory configuration over substantially their entire length, with the two undulatory lateral edge parts of each locking tab running parallel to each other over their whole length, and openings in the other base panel having lateral edges which are arranged for holding the associated locking tab engaged within the opening.

In the arrangement disclosed in GB No. 2 019 804B, some twisting of the locking tab occurs because of the alternating relationship of the corrugations at respective opposed edges of the locking tab. Although this arrangement has been found effective, in some applications it is thought that it would be advantageous to even further reduce the so called "engagement spacing" of the locking tab and also to increase the locking strength by minimising twisting of the locking tab.

To this end, one aspect of the present invention provides panel interlocking means for securing together a pair of panels in overlapping relationship including a locking tab struck from one of the panels and arranged to be driven through a locking aperture struck from the other panel, characterised in that each lateral edge of the locking tab is formed with a plurality of deformable marginal portions or fingers which are selectively deformed by engagement with the opposed lateral edges of the locking aperture dependent upon the extent to which said locking tab is driven into said locking aperture whereby said locking tab may be locked in the locking aperture in a plurality of selected positions.

In the preferred embodiment, the width of the locking tab as measured from one of its lateral edges to the other of its lateral edges is greater than the width of the locking aperture.

According to another feature of this aspect of the invention, the deformable portions or fingers each may be defined by a pair of successive cut lines in the marginal edge portions of the locking tab. Preferably, the cut lines in one lateral edge are aligned with the cut lines in the opposite lateral edge. The opposed cut lines may be convergent in a direction towards a base of the locking tab.

According to yet another feature of the invention, the locking aperture may provide a retaining tab for supporting the locking tab in a locked position. Preferably, the locking aperture has lateral edges which diverge towards the base of the retaining tab for holding the associated locking tab engaged within the locking aperture.

According to a still further feature of the invention, the lateral edges of the locking tab may be longer than the lateral edges of the locking aperture.

Another aspect of the invention provides panel interlocking means for securing together a pair of panels in overlapping relationship, includes a locking tab struck from one of the panels and arranged to be driven into a locking aperture struck from the other panel characterised in that at least one of the opposed lateral edges of the locking tab has deformable marginal portions or fingers which selectively are deformed by a corresponding lateral edge of the locking aperture dependent upon the extent to which said locking tab is driven into said locking aperture whereby said locking tab may be locked in the locking aperture in a plurality of selected positions.

Yet another aspect of the invention provides a carton blank for forming a carton of the wrap-around type which blank provides a pair of overlapping base panels of the carton, said pair of panels having panel interlocking means as described above for adjusting the girth of the carton.

An embodiment of the invention will now be described, by way of example, with reference to the accompanying drawings, in which.

Figure 1:
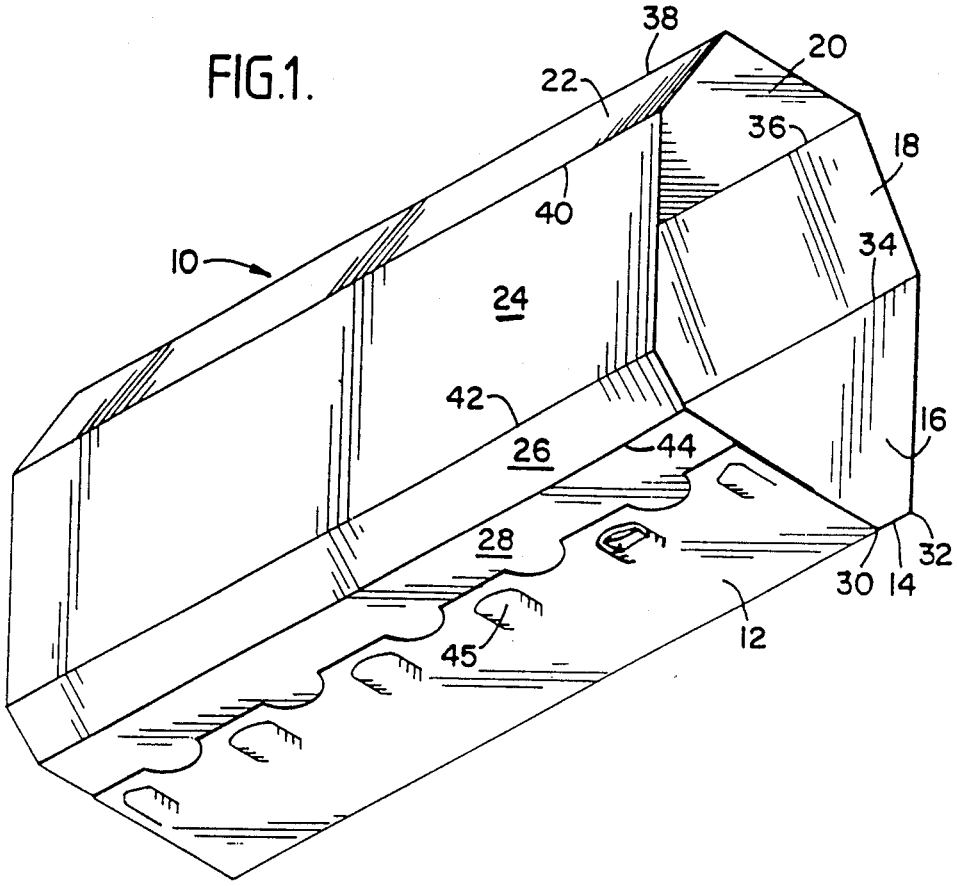
FIG. 1 is a schematic perspective view of a wrapper blank formed into its tubular configuration with its base panels overlapped and one of its locking tabs engaged.

Referring to the drawings, the wrapper 10 is formed from a blank of paperboard or similar foldable sheet material and comprises in series a first base panel 12, a first lower side wall panel 14, a first main side wall panel 16, a first upper side wall panel 18, a top wall panel 20, a second upper side wall panel 22, a second main side wall panel 24, a second lower side wall panel 26 and a second base panel 28 hinged one to the next by fold lines 30–44. In practice, the sloping upper and lower side wall panels are formed with openings for receiving portions of articles e.g. neck and heel portions to be packaged. Also, the base panels normally include triangular handling openings used to draw the two base panels towards one another into overlapping relationship prior to locking.

Figure 2:
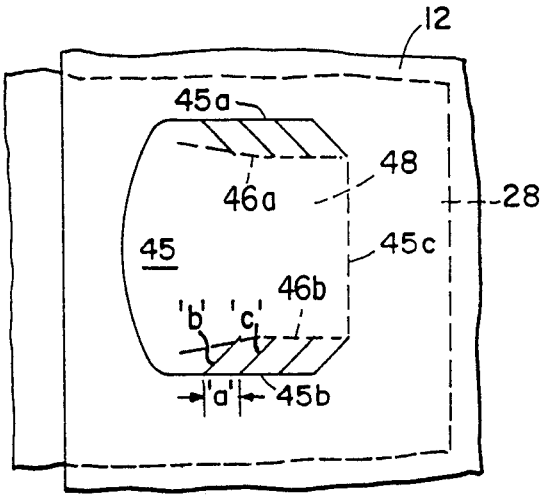
FIG. 2 is a fragmentary plan view of the overlapped base panels showing a single locking tab in position to be driven through a locking opening.
Figure 3:
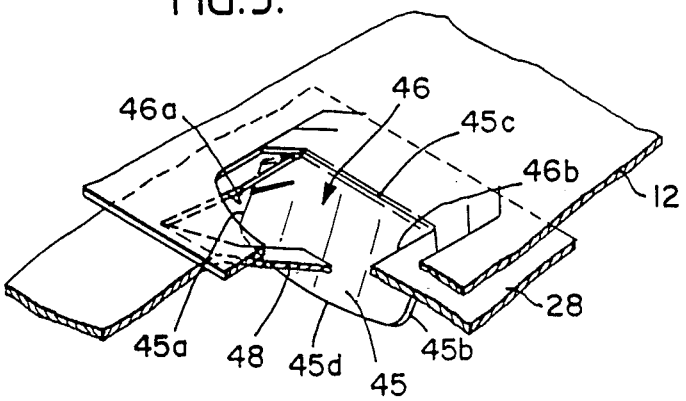
FIG. 3 is a perspective fragmentary view in part cross-section showing a single locking tab interlocked within a locking aperture.

A series of locking tabs 45 are struck from the base panel 12 adjacent its free edge and each tab includes opposed lateral edges 45*a*, 45*b*, respectively, and a base part 45*c* by which it is hinged to the base panel 12 and an opposed leading nose portion 45*d*. A series of retaining tabs 48 are struck from the other base panel 28 adjacent its free end and each retaining tab defines a locking aperture 46 at locations arranged so as to correspond with the locking tabs 45 when the wrapper is formed. Each locking aperture 46 has opposed lateral edges 46*a*, 46*b*, respectively. FIGS. 1 and 3 show that when the wrapper is formed and the base panels 12, 28 interlocked, the locking tabs 45 are folded about their base portions 45*c* and driven into the locking aperture 46 where they are supported in this position by the retaining tabs. The particular form of the locking tabs can be seen in FIGS. 2 and 3. At each of their lateral edges, the locking tabs are formed with a series of short cut lines which extend into marginal edge portions of the tab. Successive cut lines define between them a deformable portion or finger e.g. deformable marginal portion or finger 'a' is defined by successive cut lines 'b' and 'c'. Thus, a plurality (in this embodiment three) of deformable marginal portions or fingers are provided along the marginal lateral edge portions of each locking tab so that it can engage in a locking aperture in a plurality of different positions.

The lateral edges 46*a*, 46*b* of each locking aperture 46 diverge towards the base of the associated retaining tab 48. These edges may be parallel at their ends remote from the base of each retaining tab as can be seen by the broken lines in FIG. 2. The width (as measured between the opposted lateral edges) of each opening is selected so that it is approximately in alignment with the 'roots' of the deformable edge portions or fingers of the locking tabs i.e. the parts of the deformable portions remote from the lateral edges of the locking tabs across the ends of adjacent cut lines.

When locking of the base panels is effected, each locking tab 45 is caused to penetrate into a corresponding locking aperture and thereby displace the retaining tab. Since the width of the locking tab is greater than that of its locking aperture, as implied above, the opposed deformable edge portions or fingers of the locking tab are displaced by abutment against the lateral edges of the locking aperture until the lateral edges of the locking aperture are engaged between the locking edges of the locking tab formed by the cut lines upon displacement of the deformable portion or fingers therebetween. FIG. 3 shows the locking tab less than fully inserted into the locking aperture to an intermediate locked position whereby the wrapper girth will have a dimension somewhat between its maximum and minimum girth dimension. In practice, the relative position of the base panels which dictates the extent to which the locking tabs are engaged is set by the articles to be packaged.

The cut lines "b", "c" defining the deformable portions or fingers of the locking tab are shown to be convergent in a direction towards the base 45*c* of the locking tab. Whereas the cut lines may also be normal to the lateral edges or convergent in a direction towards the base 45*c*, the particular arrangement shown is thought to facilitate the displacement of the deformable portions or fingers defined by the cut lines. Moreover, it is envisaged that the cut lines need not necessarily be either parallel, equi-distant from one another nor indeed straight.

The divergent portion of the locking aperture 46 provides a broader initial entry portion for the locking tab which also facilitates insertion of the locking tab. It is therefore possible for the length of the lateral edges 45*a*, 45*b* of the locking tab to be substantially longer than the lateral edges 46*a*, 46*b* of the locking aperture so as to accommodate a larger range of bottle variations.

The 'engagement spacing' is represented by distance 'a' between two adjacent cut lines and this distance can be varied by different cut patterns so that the spacing is more cognizant of small tolerance differences in bottle diameters. For any given lateral edge length a greater number of deformable portions or fingers may be provided by decreasing the spacing between cut lines so that the locking tab may be engaged at a greater number of locations than was possible heretofore.

In some arrangements where space is limited 'half' locks may be provided, that is where the locking tab includes deformable portions or fingers along only one of its lateral edges.

I claim:

1. A panel interlocking means for securing together a pair of panels in overlapping relationship comprising a locking tab of generally U-shaped configuration struck from one of said panels and an elongated locking aperture provided in the other of said panels and arranged to receive and retain said locking tab, said locking tab being hinged to said one panel at a base and having opposed lateral edges which prior to engagement of the locking tab in said locking aperture are defined by straight and uninterrupted cuts, said locking aperture comprising spaced lateral edges which are generally aligned with the lateral edges of said locking tab when the locking tab is engaged within the locking aperture, characterised in that each lateral edge of the locking tab provides a plurality of deformable marginal portions formed by cuts extending inwardly from said lateral edges of said locking tab, said marginal portions being selectively deformed by engagement with the lateral edges of the locking aperture at a location dependent upon the extent to which said locking tab is driven into said locking aperture whereby said locking tab may be locked in the locking aperture in a plurality of selected positions.

2. Panel interlocking means according to claim 1, further characterised in that the lateral edges of the locking tab are substantially parallel with each other.

3. Panel interlocking means according to claim 1, further characterised in that the width of the locking tab as measured from one of its lateral edges to the other of its lateral edges is greater than the width of the locking aperture.

4. Panel interlocking means according to claim 3, further characterised in that said deformable portions are defined by successive cut lines in the marginal edge portions of the locking tab.

5. Panel interlocking means according to claim 4, further characterised in that the cut lines in the respective edge portions are substantially parallel with each other and the cut lines in one lateral edge portion are generally aligned with the cut lines in the opposite lateral edge portion.

6. Panel interlocking means according to claim 4, further characterised in that the cut lines are convergent in a direction towards the base of the locking tab.

7. Panel interlocking means according to claim 4, further characterised in that the cut lines are divergent with respect to the base of the locking tab.

8. Panel interlocking means according to claim 4, further characterised in that the locking aperture is defined by a retaining tab arranged to support the locking tab in locked position within the locking aperture, said retaining tab being hinged to said other panel at a base which is spaced from the base of the locking tab when said panels are disposed in overlapping relationship and the locking tab is engaged within the locking aperture.

9. Panel interlocking means according to claim 8, further characterised in that the lateral edges of the locking aperture diverge towards the base of the retaining tab.

10. Panel interlocking means according to claim 3, further characterised in that the lateral edges of the locking tab are longer than the lateral edges of the locking aperture.

11. Panel interlocking means for securing together a pair of panels in overlapping relationship, comprising a locking tab struck from one of the panels and a locking aperture struck from the other panel and arranged to receive and retain said locking tab, said locking tab being hinged to said one panel at a base and having opposed lateral edges which prior to engagement of the locking tab in said locking aperture are defined by straight and uninterrupted cuts, said locking aperture comprising spaced lateral edges which are generally aligned with the lateral edges of said locking tab when the locking tab is engaged within the locking aperture, characterised in that at least one of the lateral edges of the locking tab provides deformable marginal portions formed by cuts extending inwardly from said one lateral edge, said marginal portions being selectively deformed by a cooperating lateral edge of the locking aperture at a location dependent upon the extent to which said locking tab is driven into said locking aperture whereby said locking tab may be locked in the locking aperture in a plurality of selected positions.

12. A panel interlocking means for securing together a pair of panels in overlapping relationship comprising a locking tab of generally U-shaped configuration struck from one of said panels and an elongated locking aperture provided in the other of said panels and arranged to receive and retain said locking tab, said locking tab being hinged to said one panel at a base and having opposed lateral edges, said locking aperture comprising lateral edges which are spaced apart less than the maximum width of said locking tab as measured between the opposed lateral edges thereof and which are generally aligned with the lateral edges of said locking tab when the locking tab is engaged within the locking aperture, characterised in that the locking tab is provided with a plurality of relatively short cut lines which are arranged in spaced relationship with each other along at least one of said opposed lateral edges and which extend inwardly therefrom to form a plurality of fingers between successive cut lines, at least one of said fingers being selectively deflected by engagement with the adjacent lateral edge of the locking aperture at a location dependent upon the extent to which said locking tab is driven into said locking aperture whereby said locking tab may be locked in the locking aperture in a selected one of a plurality of positions.

13. Panel interlocking means according to claim 12, further characterised in that the locking aperture is defined by a retaining tab arranged to support the locking tab in locked position within the locking aperture, said retaining tab being hinged to said other panel at a base which is spaced from the base of the locking tab when said panels are disposed in overlapping relationship and the locking tab is engaged within the locking aperture.

14. Panel interlocking means according to claim 13, further characterised in that the lateral edges of the locking aperture diverge towards the base of the retaining tab.

15. A blank for forming a carton of the wraparound type including a pair of panels which are secured in overlapping relationship when the carton is assembled, said pair of panels having panel interlocking means according to claim 12.

* * * * *